US010525515B2

(12) United States Patent
Sasaki et al.

(10) Patent No.: US 10,525,515 B2
(45) Date of Patent: Jan. 7, 2020

(54) ROLL-BENDING PROCESSING METHOD AND PROCESSING DEVICE

(71) Applicant: FUKUI PREFECTURAL GOVERNMENT, Fukui-shi, Fukui (JP)

(72) Inventors: Yoshinori Sasaki, Fukui (JP); Masami Matsumura, Fukui (JP)

(73) Assignee: FUKUI PREFECTURAL GOVERNMENT, Fukui-shi, Fukui (JP)

( * ) Notice: Subject to any disclaimer, the term of this patent is extended or adjusted under 35 U.S.C. 154(b) by 378 days.

(21) Appl. No.: 15/327,420

(22) PCT Filed: Aug. 4, 2015

(86) PCT No.: PCT/JP2015/072046
§ 371 (c)(1),
(2) Date: Jan. 19, 2017

(87) PCT Pub. No.: WO2016/021578
PCT Pub. Date: Feb. 11, 2016

(65) Prior Publication Data

US 2017/0157660 A1 Jun. 8, 2017

(30) Foreign Application Priority Data

Aug. 5, 2014 (JP) ..... 2014-159405

(51) Int. Cl.
*B21D 5/14* (2006.01)
*B21D 43/09* (2006.01)
(Continued)

(52) U.S. Cl.
CPC ..... *B21D 5/14* (2013.01); *B21D 5/08* (2013.01); *B21D 7/12* (2013.01)

(58) Field of Classification Search
CPC . B21D 5/004; B21D 5/14; B21D 7/08; B21D 7/12; B21D 43/09; B21D 5/08
(Continued)

(56) References Cited

U.S. PATENT DOCUMENTS

2010/0281942 A1 11/2010 Carlini

FOREIGN PATENT DOCUMENTS

JP 45-25171 B 8/1970
JP 03-258416 A 11/1991
(Continued)

OTHER PUBLICATIONS

English translate JP2011062738, retrieved date Mar. 19, 2019.*
(Continued)

*Primary Examiner* — Adam J Eiseman
*Assistant Examiner* — Mohammed S. Alawadi
(74) *Attorney, Agent, or Firm* — Sughrue Mion, PLLC

(57) ABSTRACT

A method for deriving the position of a pushing roll, applied even when there is a difference between the actual processed shape and a theoretical solution (a numerical analysis solution) due to changes in a state of a processing machine or the bending characteristic of the material to be processed. The rolls have a pyramid-like shape, and the operation amount of a pushing roll is changed while continuously feeding a material, thereby bending the material. Also, for each position of the fixed pushing roll, the radius of curvature of the material is measured and the bending characteristic is grasped in advance. From the design shape, the radius of curvature and the operation amount for bringing the pushing roll into contact are obtained. The operation amount of the pushing roll is then determined.

5 Claims, 8 Drawing Sheets

(51) Int. Cl.

| | |
|---|---|
| ***B21D 5/00*** | (2006.01) |
| ***B21D 7/12*** | (2006.01) |
| ***B21D 5/08*** | (2006.01) |

(58) Field of Classification Search
USPC ..... 72/27, 128, 66, 127, 166–175
See application file for complete search history.

(56) References Cited

FOREIGN PATENT DOCUMENTS

| | | | |
|---|---|---|---|
| JP | 06-190453 | A | 7/1994 |
| JP | 2011-062738 | A | 3/2011 |
| JP | 2011-508674 | A | 3/2011 |

OTHER PUBLICATIONS

Toshio Yamakawa et al., "Modified Shape Bending Processing by Three Rolls in Pyramid-like Shape," The Japan Society for Technology of Plasticity, Sosei to Kakou (Plasticity and Processing), 1977, pp. 106-113, vol. 18, No. 193.
Cyoichiro Soda et al., "Deformation of Plate by Three-roll Bending," The Japan Society for Technology of Plasticity, Plasticity and Processing, 1962, pp. 474-484, vol. 3, No. 18.
International Search Report of PCT/JP2015/072046 dated Oct. 13, 2015 [PCT/ISA/210].

* cited by examiner (a) (b)

ROLL-BENDING PROCESSING METHOD AND PROCESSING DEVICE

CROSS REFERENCE TO RELATED APPLICATIONS

This application is a National Stage of International Application No. PCT/JP2015/072046, filed Aug. 4, 2015, claiming priority based on Japanese Patent Application No. 2014-159405, filed Aug. 5, 2014, the contents of all of which are incorporated herein by reference in their entirety.

TECHNICAL FIELD

The present invention relates to a bending processing method for carrying out bending processing while continuously feeding a material to be processed made of a metal with rolls being configured in a pyramid-like shape, and to a processing device.

BACKGROUND ART

There is roll-bending processing as a method for carrying out bending processing of a thin plate or a wire rod. This is processing that acts bending stress on a material to be processed and bends the material, by controlling a feeding amount of the material to be processed fed to a processing part configured of at least three rolls and a position of at least one roll of the processing part. In the processing method, an arbitrary curvature can be imparted to a material to be processed without using a die, and thus there is an advantage that the cost is lower than that of bending by press.

However, when a material to be processed is made of a metal, springback is generated by removal of the bending stress and a radius of curvature is changed. When a radius of curvature of a design shape is constant, processing can be carried out comparatively easily by appropriately adjusting the position of a pushing roll. However, in a case of a design shape in which a radius of curvature is changed, setting of the pushing roll position becomes very difficult. There are Patent Literatures 1 to 3 as conventional technologies of bending using rolls.

In Patent Literature 1, there is disclosed a technology about a bending processing method of a steel plate or the like. Specifically, a cam of a similar figure to a design shape is rotated in synchronization with rotation of a supply roll, and at the same time, a displacement magnitude of a follower paired with the cam is converted to an electric quantity, and an elevation amount of a pushing roll is controlled via a hydraulic servo or the like, and thus a curved plate, a pipe or a tubular body is automatically formed.

In Patent Literature 2, there is disclosed a technology about a bending processing method of a metal material by a bending roll and a device thereof. Specifically, there is disclosed a method in which bending processing is experimentally carried out in advance and average value data of springback ratios are collected and stored in a memory, and an intended springback ratio is obtained by the use of the data at an intended processing radius, and in which processing conditions considering springback are found from the springback ratio.

In Patent Literature 3, there are disclosed technologies concerning a roll bending method and device. Specifically, there is disclosed a processing method in which, in pinch-shape roll bending, a position of a pushing roll at which the pushing roll makes contact with a material to be processed is calculated from a geometric relationship between a roll arrangement and a processing shape, and in which push-in amount for imparting a curvature is derived from elasto-plasticity simulation by a finite element method or the like until the calculated position of the pushing roll falls within the allowable deviation.

In Non Patent Literature 1, there is disclosed a technology concerning bending processing in a modified shape by pyramid-shaped three rolls based on Non Patent Literature 2. Specifically, in the pyramid-shaped three rolls, variously different bending shapes are automatically processed by numerically controlling a feeding amount of a material to be processed and the position of the central roll. In deriving the roll position, the processing by the use of roll press bending is started, and thus a subsequent wire rod shape between rolls is obtained by carrying out sequential calculation from the relationship between push-in amount and moment, with the result that the position of the roll for carrying out processing into an intended shape is determined.

CITATION LIST

Patent Literature

PTL 1: Japanese Published Examined Application No. 45-25171

PTL 2: Japanese Patent Laid-Open No. 06-190453

PTL 3: Japanese Patent Laid-Open No. 2011-62738

Non Patent Literature

NPL 1: T. Yamakawa and three others, "Modified Shape Bending Processing by Three Rolls in Pyramid-like Shape," The Japan Society for Technology of Plasticity, Sosei to Kakou (Plasticity and Processing), Vol. 18, No. 193, 1977

NPL 2: C. Soda, S. Konishi, "Deformation of Plate by Three-roll Bending," The Japan Society for Technology of Plasticity, Plasticity and Processing, Vol. 3, No. 18, 1962

SUMMARY OF INVENTION

Technical Problem

However, there are problems as described below in Patent Literatures 1 to 3 and Non Patent Literature 1. In the processing in Patent Literature 1, an elevation amount of a pushing roll is controlled by a control voltage obtained by causing a follower to follow a cam similar to a design shape and converting the displacement magnitude thereof to an electric quantity. However, when a metal material is subjected to bending processing, springback is generated, and the magnitude thereof changes in accordance with a processing curvature. The countermeasure for this is not disclosed.

As to the method in Patent Literature 2, a method for obtaining a processed material having a constant curvature is described. There is not shown a method for obtaining a design shape in which the curvature successively changes.

The processing in Non Patent Literature 1 makes it possible to process an arbitrary shape by control of the roll position in pyramid-shaped three-roll bending and the feeding amount of a material to be processed. However, in order to sequentially derive the shape of wire rod between rolls from the relationship between push-in amount and moment, it is necessary to set the initial bending processing to roll pushing bending. In addition, since the calculation is very complicated and is based on Non Patent Literature 2, a range of processable curvatures is limited to 20 $m^{-1}$ or less (radius of curvature of 50 mm or more).

In the method in Patent Literature 3, there is clarified a calculation method of a pushing roll position where the pushing roll makes contact with a material to be processed from the geometric relationship between a roll arrangement and a processing shape. As to derivation of a pushing roll position for imparting a curvature to a material to be processed is a method in which a state where the material to be processed and a pushing roll are brought into contact is set to an initial state and repeated calculations are carried out until the processing curvature converges into an allowable deviation by a finite element method. The method corresponds to one in which, in Non Patent Literature 1, the pyramid-like shape is replaced by a pinch type in the processing method and the sequential calculation is replaced by a finite element method in the calculation method.

Accordingly, there is a common problem in Non Patent Literature 1 and Patent Literature 3 such that they cannot cope with a minute change in processing conditions. A first minute difference in processing conditions includes clearance required for assembling parts constituting a processing machine. Clearance is indispensable for carrying out disassembly/assembly of the processing machine. Therefore, when the processing machine is re-configured, a roll position minutely differs. Even if the difference is minute, the radius of curvature to be formed changes largely.

Furthermore, change in a forming curvature caused by a wire rod to be processed also exists. Even if the types of materials to be processed are the same model number, bending characteristics become different when manufacturing lots are different from each other. Moreover, a material to be processed is usually distributed in a state of being wound around a bobbin or a drum in order to enhance an efficiency of transport and working space. Accordingly, prior to processing, there is required a correction process that eliminates curling, and the correction process changes in accordance with the diameter of the bobbin around which the material is wound. These also cause changes in the bending characteristic.

As a result of these minute changes in processing conditions, the processing curvature is different from the theoretical value described in Non Patent Literature 2, even when the processing is stationary bending in which the position of a pushing roll is fixed. In this case, even when the push-in amount of a pushing roll is derived by the method according to Non Patent Literature 1, a design shape cannot be obtained. The same also applies to the method in Patent Literature 3, in which the position of a pushing roll is derived using a finite element method or the like. Fine adjustment is necessary so that an analysis result by a finite element method and a processing result by a processing machine become identical with each other.

Accordingly, the present invention aims at providing a roll-bending processing method and a processing device capable of coping with changes even if there are the changes in a state of processing machine and in a bending characteristic of a material to be processed, and capable of carrying out highly accurate bending processing.

Solution to Problem

In order to achieve the above purpose, the method according to the present invention has features as described below.

(1) A roll-bending processing method of arranging a fulcrum roll on one side of a feeding path of a material to be processed and arranging a pressing roll and a pushing roll on the other side thereof; and bending the material to be processed by controlling an operation amount of the pushing roll while continuously feeding the material to be processed, the method including:

calculating reference data under an unloaded condition on the basis of bending characteristic data of a material to be processed obtained by carrying out a prescribed stationary bending experiment; calculating design data under the unloaded condition on the basis of a design shape; and calculating an operation amount of the pushing roll on the basis of the reference data and the design data to thereby carryout bending processing.

(2) The roll-bending processing method according to (1), the method further including:

calculating, as the reference data, a bending moment per unit stationary bending curvature operation amount corresponding to an unloaded moment arm;

calculating, as the reference data, a design radius of curvature, an unloaded moment arm and a design geometric operation amount for every point of a design shape; and acquiring the bending moment per unit stationary bending curvature operation amount of the reference data on the basis of the unloaded moment arm of the design data for every point of the design shape, obtaining a design curvature operation amount by dividing a design required moment for bending the material to be processed into a design radius of curvature by the acquired bending moment per unit stationary bending curvature operation amount, and adding together the obtained design curvature operation amount and the design geometric operation amount to thereby calculate the operation amount of the pushing roll.

(3) The roll-bending processing method according to (2), the method further including: calculating, as the reference data, the unit stationary bending curvature operation amount in accordance with the unloaded moment arm in a case where the material to be processed makes contactor does not make contact with an interference prevention guide, and selecting the unit stationary bending curvature operation amount in accordance with the unloaded moment arm in either of cases where the material to be processed makes contactor does not make contact with an interference prevention guide to thereby calculate the operation amount of the pushing roll.

(4) The roll-bending processing method according to (2) or (3), the method further including: calculating, as the reference data, an unloaded moment arm for correction independently of the unloaded moment arm, and correcting the operation amount of the pushing roll on the basis of the unloaded moment arm for correction.

(5) A roll-bending processing device including: a feeding part that continuously feeds a material to be processed along a prescribed feeding path; a working part in which a fulcrum roll is arranged on one side of the feeding path, in which a pressing roll and a pushing roll are arranged on the other side, and which carries out bending processing by pushing the pushing roll against the material to be processed; and a controlling part that controls an operation amount of the pushing roll while continuously feeding the material to be processed toward the pushing roll by controlling the feeding part to thereby bend the material to be processed, wherein the controlling part includes: a preliminary processing part that calculates reference data under an unloaded condition on the basis of bending characteristic data of a material to be processed obtained by carrying out a prescribed stationary bending experiment; a design processing part that calculates design data under an unloaded condition on the basis of a design shape; and a calculation processing part that calculates an operation amount of the pushing roll on the basis of the reference data and the design data.

Advantageous Effects of Invention

The roll-bending method of the present invention having such features gives following function and effect. Even when an actual processed shape generates a difference from a theoretical solution due to changes in a state of a processing machine or the bending characteristic of the material to be processed, it becomes possible to carry out bending processing with high accuracy in consideration of the influence of springback. A design shape can be processed even when the design shape has a shape in which the curvature continuously changes, or a shape having a plurality of bending parts with different radii and straight line parts.

DESCRIPTION OF EMBODIMENTS

Hereinafter, embodiments of the present invention will be described in detail on the basis of the drawings. Embodiments to be described are specific examples that are preferable when the invention is practiced, and thus various technical limitations are imposed, but the present invention is not limited to these forms unless it is clearly stated in the description below that the present invention is limited particularly. Furthermore, terms expressing a specific direction or position (such as "upper," "lower," "right" and other terms including these terms) are used as necessary, and these terms are used for making understanding of the invention with reference to the drawings easy, but the technical scope of the present invention is not limited by the meaning of these terms. Note that, in order to distinguish between a state after the completion of springback and a state during processing, a radius of curvature or the like is expressed with "′" attached to variables after the springback.

(First Embodiment)

Figure 1:
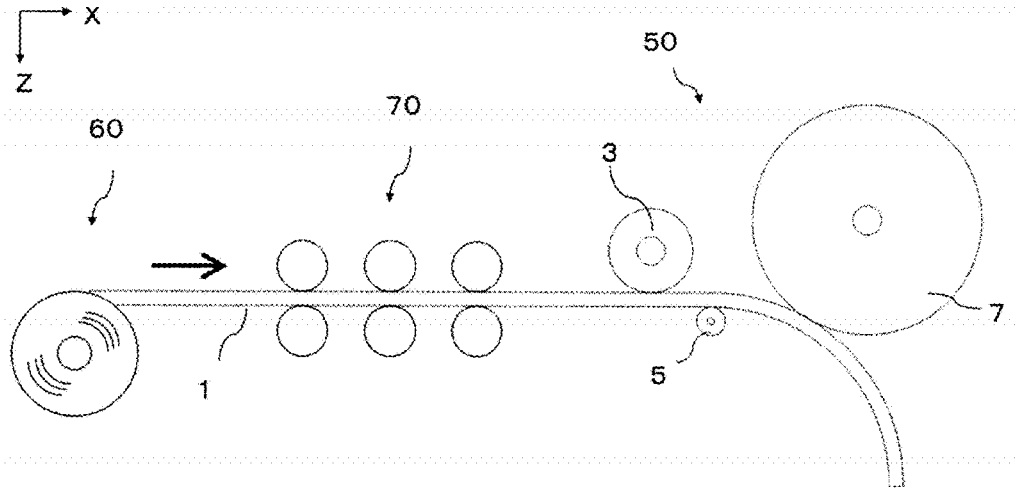
FIG. 1 is a schematic configuration view about a roll-bending processing device of a first embodiment according to the present invention.

FIG. 1 is a schematic configuration view about the roll-bending processing device of a first embodiment according to the present invention. The roll-bending processing device includes a supply part 60 that supplies a material to be processed 1, a feeding part 70 that continuously feeds the material to be processed 1 at a prescribed feeding speed, and a working part 50 that subjects the material to be processed 1 to bending processing. In the example, the material to be processed 1 fed out from a supply roll of the supply part 60 is fed in an arrow direction while being sandwiched by a plurality of feeding rolls and is subjected to bending processing at an intended curvature in the working part 50. Hereinafter, the right direction in FIG. 1 is defined as the X direction, and the lower direction is defined as the Z direction.

Figure 2:
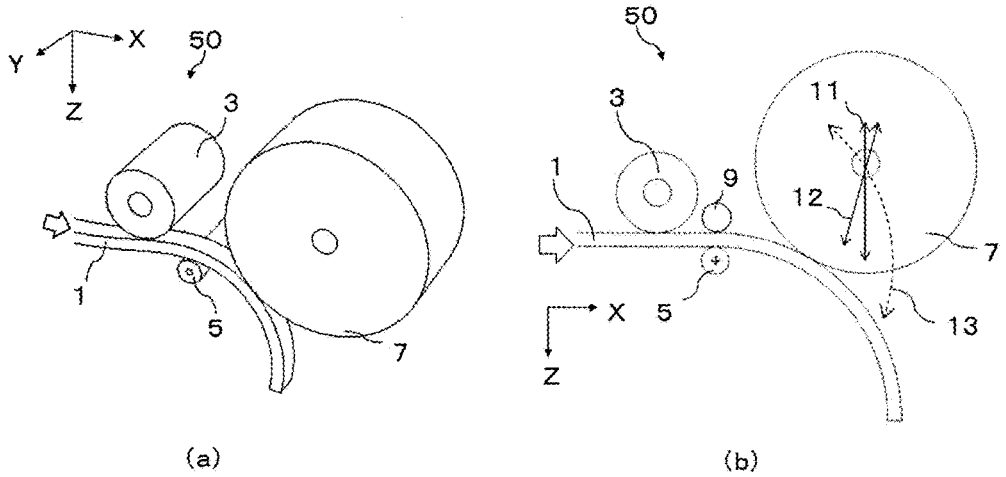
FIG. 2 is a schematic configuration view about a working part 50.

FIG. 2 is a schematic configuration view about the working part 50. As shown in FIG. 2(*a*), the material to be processed 1 is continuously fed out to the working part 50 in an outline arrow direction in the drawing by the feeding part 70. The working part 50 has a pressing roll 3 that abuts on the material to be processed 1 so as to feed the material to be processed 1 along a prescribed feeding path, a fulcrum roll 5 serving as a point of action of the maximum bending moment for the material to be processed 1 at the time of bending processing, and a pushing roll 7 that makes contact with the fed out material to be processed 1 and imparts bending stress to the material to be processed 1. In addition, the fulcrum roll 5 is arranged on one side of the feeding path of the material to be processed 1, and the pressing roll 3 and the pushing roll 7 are arranged on the other side. Such arrangement of three rolls is referred to as generally rolls of pyramid-shaped rolls.

As shown in FIG. 2(*b*), a facing roll 9 making a pair with the fulcrum roll 5 may be arranged to thereby constitute a pinch-type roll, as necessary. Desirably, the pressing roll 3, the fulcrum roll 5, the pushing roll 7 and the facing roll 9 are axially supported rotatably in order to reduce friction with a material to be processed.

The pushing roll 7 can move in a direction that intersects with the material to be processed 1 as shown in FIG. 2(*b*), for example, as an allow 11 or an arrow 12, by a position adjusting device (not shown), so as to impart a bending moment to the material to be processed 1. Alternatively, the pushing roll 7 may be circularly moved as an arrow 13. The center of the arc of the arrow 13 is the center of shaft of the fulcrum roll 5, but it may be other than the center of shaft of the fulcrum roll 5.

Figure 3:
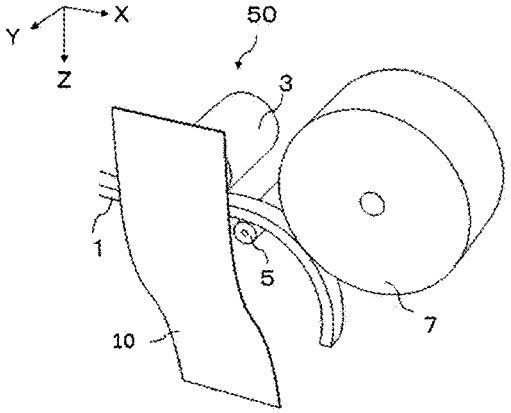
FIG. 3 is a schematic configuration view about the working part 50 at which an interference prevention guide 10 is disposed.

According to a design shape, as shown in FIG. 3, suitable disposition of an interference prevention guide 10 is desirable in order to prevent interference of the material to be processed 1 with the material to be processed 1 itself or with various rolls.

Bending processing to be described below is assumed to be carried out based on a linear motion of the pushing roll 7 in an arrow 11 (the direction orthogonal to the feeding direction of the material to be processed 1) in a pyramid-shaped roll arrangement shown in FIG. 2(*a*), and there will be described a case where the cross-section in the direction orthogonal to the feeding direction of the material to be processed 1 has a rectangular cross-section of t in thickness and b in width. Radii of the fulcrum roll 5 and the pushing roll 7 are denoted by $r_5$ and $r_7$, respectively.

Figure 4:
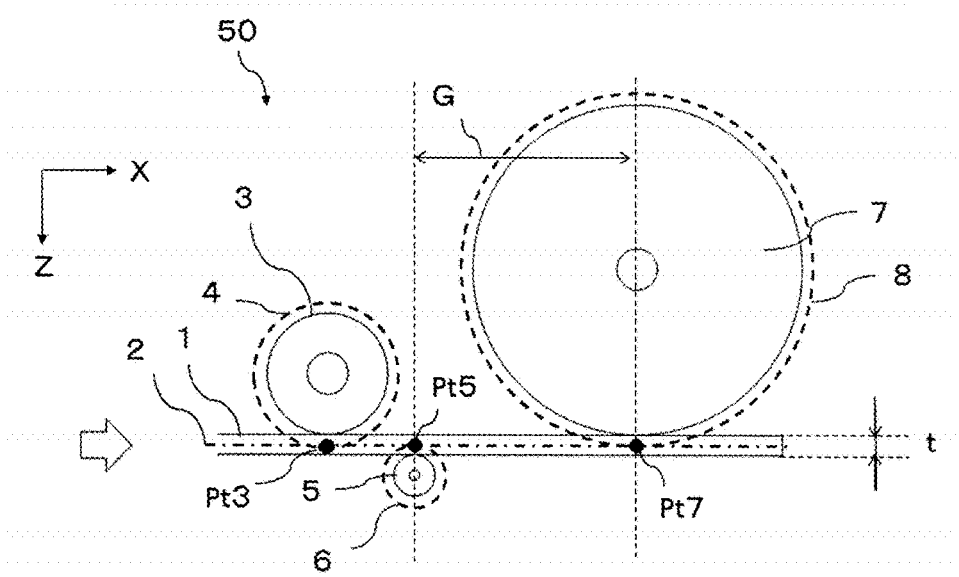
FIG. 4 is a side view when an operation amount of a pushing roll 7 is 0, in a roll bending device according to the present invention.

As shown in FIG. 4, when the material to be processed 1 is continuously fed at a prescribed feeding speed and fed out in a linear state, a position at which the material to be processed 1 makes contact with the pushing roll 7 in a state where stress is not generated is defined as an operation amount 0 of the pushing roll 7 (an operation amount when the roll 7 moves in the direction of an arrow 11 or an arrow 12 is a moving distance. Furthermore, an operation amount when the roll 7 moves based on an arrow 13 is a moving distance or a rotation angle.).

At an operation amount 0, the lower end of the pushing roll 7 is positioned above (in −Z direction) the upper end of the fulcrum roll 5 by the thickness t of the material to be processed 1. A contact point of a neutral line 2 of the material to be processed 1 with a pressing roll offset circle 4 obtained by offsetting the pressing roll 3 by the distance 0.5 t to the neutral line is denoted by Pt3, and in the same way, a contact point with a fulcrum roll offset circle 6 obtained by offsetting the fulcrum roll 5 by the distance 0.5 t is denoted by Pt5, and a contact point with a pushing roll offset circle 8 obtained by offsetting the pushing roll 7 by 0.5 t is denoted by Pt7. When the movement of the pushing roll 7 is indicated by an arrow 11, an X-direction distance between centers of the fulcrum roll 5 and the pushing roll 7 is constant, the distance being denoted by G.

Figure 5:
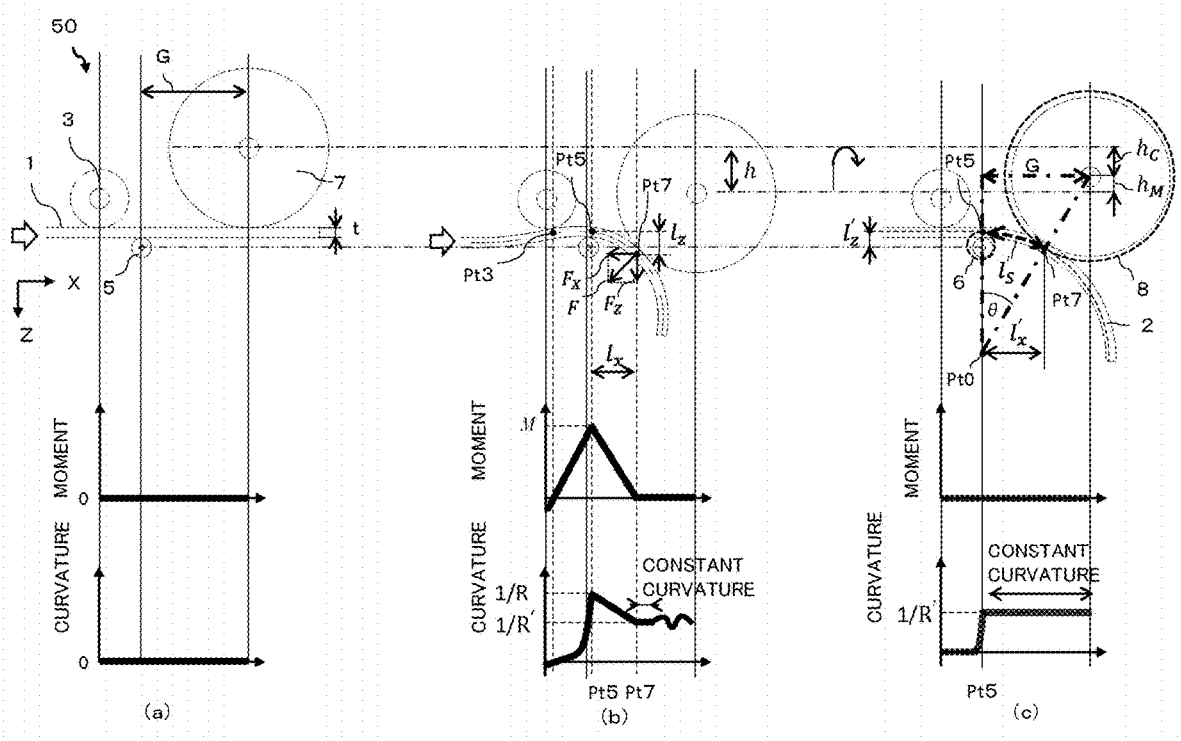
FIG. 5 is a schematic view of a stationary bending experiment.

FIG. 5 is an explanation view about bending processing. In FIG. 5, there are represented positional relationship among the pressing roll 3, the fulcrum roll 5 and the pushing roll 7, and a graph about a moment and curvature generated at respective positions of the material to be processed 1 corresponding to the positional relationship, on the lower side. FIG. 5(*a*) shows a case where the operation amount of the pushing roll 7 is 0.

In a case where the material to be processed 1 is to be bent, as shown in FIG. 5(*b*), the pushing roll 7 is positioned in the lower direction (+Z direction) than the position shown in FIG. 5(*a*). Accordingly, the material to be processed 1 having been fed out is pushed by the pushing roll 7 and receives a bending moment. The bending moment is not determined by the position alone of the pushing roll 7, but also depends on the shape of the material to be processed 1 positioned between the fulcrum roll 5 and the pushing roll 7.

In a stationary bending in which the material to be processed 1 is sufficiently fed until a curvature to be formed becomes constant, the bending stress becomes larger as the position of the pushing roll 7 moves in the Z direction. Therefore, the curvature of the material to be processed 1 becomes larger (the radius of curvature becomes smaller).

Quality of the material to be processed 1 may be a nonferrous-based material such as aluminum or aluminum alloy, copper, copper alloy, titanium or titanium alloy, in addition to an iron-based material such as carbon steel or stainless steel. In addition, the shape of the material to be processed 1 may be plate-like, circular or rectangular, or a wire rod having a modified cross-section. The thickness of the material to be processed 1 is not limited within a range in which the plastic deformation of the fulcrum roll is not generated, and even if the fulcrum roll 5 is in an elastically deformed state, the material to be processed 1 can be bent with high accuracy.

As described above, the working part 50 controls the operation amount of the pushing roll 7 along with the feeding-out amount of the material to be processed 1 based on the feeding speed, and thus the working part 50 can impart various curvatures by changing bending stress to be added to the material to be processed 1.

Figure 6:
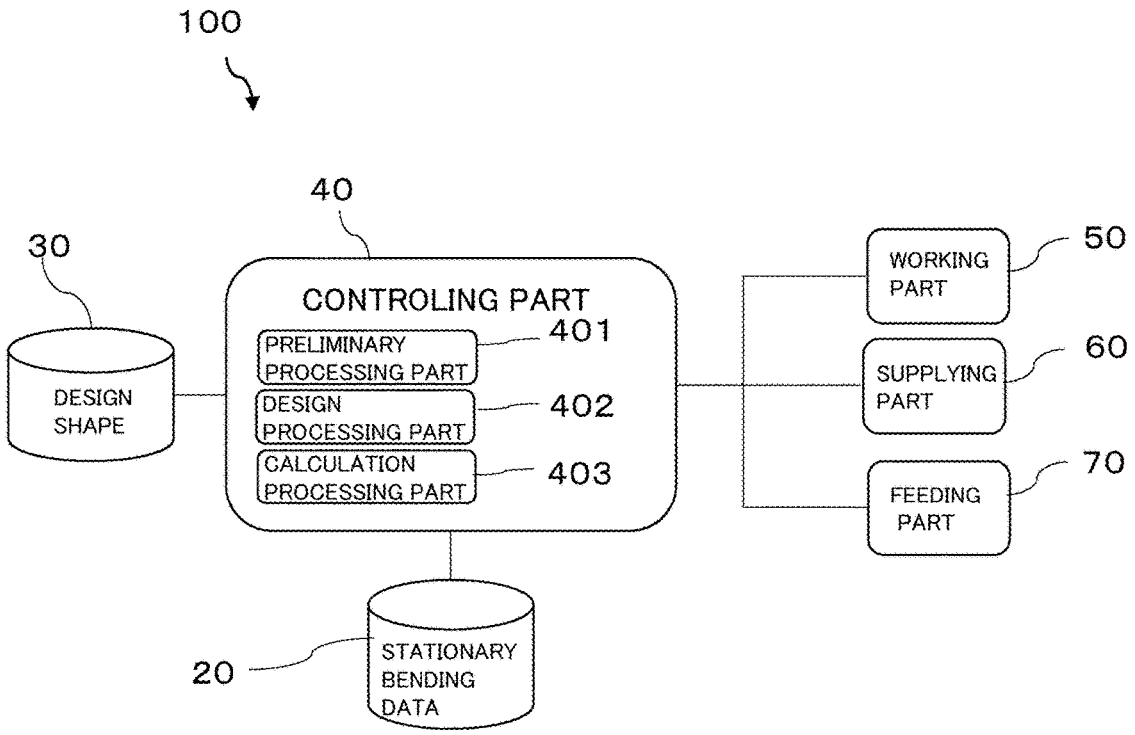
FIG. 6 is a block diagram of a roll-bending processing device according to the present invention.

FIG. 6 is a control block configuration view about a roll-bending processing device. A roll-bending processing device 100 includes a controlling part 40, the working part 50, the supply part 60 and the feeding part 70. The roll-bending processing device 100 may also include a database 20 for storing stationary bending data and a data base 30 that stores design shape data.

The controlling part 40 includes a preliminary processing part 401 that calculates reference data under an unloaded condition on the basis of bending characteristic data of a material to be processed obtained by carrying out a prescribed stationary bending experiment, a design processing part 402 that calculates design data under an unloaded condition on the basis of a design shape, and a calculation processing part 403 that carries out control so as to carry out a bending processing by calculating an operation amount of a pushing roll on the basis of the reference data and the design data.

The preliminary processing part 401 carries out a stationary bending experiment as an advance preparation for processing a design shape, and grasps bending characteristics in a combination of the working part 50 and the material to be processed 1.

In the stationary bending experiment, starting from the initial state shown in FIG. 5(*a*), the pushing roll 7 is fixed at every prescribed operation amount h, and the material to be processed 1 is fed out. The X-direction distance during processing between Pt5 and Pt7 is denoted by lx. Immediately after the feeding-out, lx and radius of curvature to be formed vary, but when the material to be processed 1 is continuously fed, as shown in FIG. 5(*b*), the radius of curvature of the material to be processed 1 fed out from Pt7 becomes constant. This state is defined as a stationary state.

In the stationary state, the bending moment acting on the material to be processed 1 increases from Pt3 toward Pt5, becomes the highest at Pt5, decreases from Pt5 toward Pt7, and becomes 0 at Pt7. On the other hand, the curvature of the material to be processed 1 increases from Pt3, becomes higher as approaching Pt5, becomes the highest at Pt5, springback progresses in accordance with the decrease in the bending moment acting after Pt5 and the curvature lowers, the bending moment acting at Pt7 becomes 0, and the springback is completed to thereby give the curvature of 1/R'.

In the stationary bending experiment, the operation amount h fixed to a prescribed value is defined as the stationary bending total operation amount h, relationship of the stationary bending radius of curvature R' to be formed is grasped, and an approximation formula for deriving h from R' is obtained. A pitch of the stationary bending total operation amount h is desirably as fine as possible.

Figure 7:
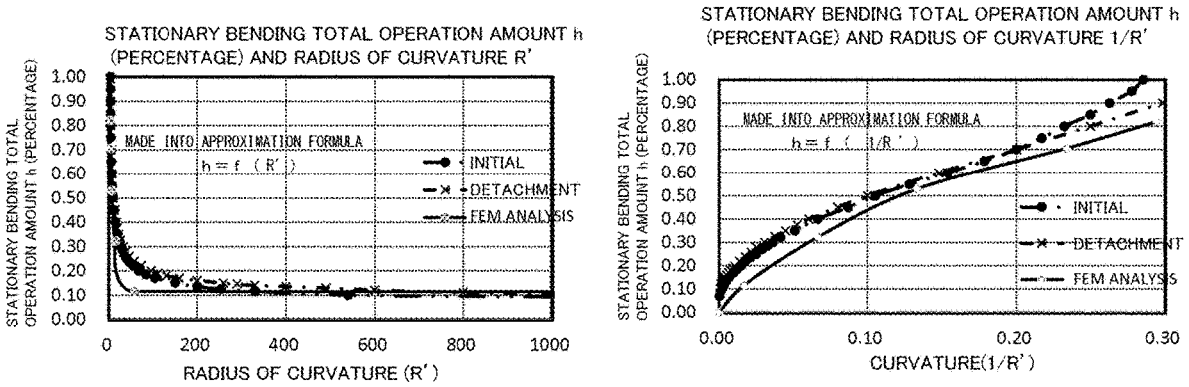
FIG. 7 is a graph of an operation amount and radius of curvature, obtained from the stationary bending experiment.

As an example, a graph of a stationary bending experiment result of a titanium alloy wire rod for eyeglass rim wire is shown in FIG. 7. In FIG. 7(*a*), the horizontal axis represents a radius of curvature R' (mm), and, in FIG. 7(*b*), the horizontal axis represents a curvature (1/R') ($mm^{-1}$). As to the number of plotting points, desirably five or more points are to be plotted so as to give approximately fixed intervals in the curvature direction of plotting points in a graph of curvature. Furthermore, an approximation formula is desirably divided into two or more groups of a small curvature region and a large curvature region.

Figure 8:
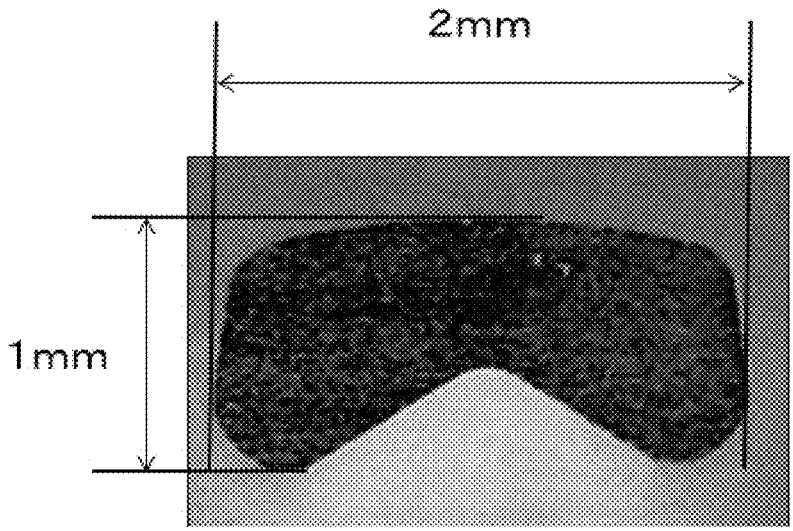
FIG. 8 is a cross-sectional view of a modified shape wire rod of a titanium alloy for eyeglasses.

The quality of the titanium alloy wire rod used for the stationary bending experiment in FIG. 7 corresponds to JIS 4650 type 61, and the cross-sectional shape is as shown in FIG. 8. The setting of roll or the like is as follow: radius $r_5$ of a fulcrum roll 5 is 1.0 mm, radius $r_7$ of the pushing roll 7 is 8.0 mm, and the X-direction distance G between centers of the fulcrum roll 5 and the pushing roll 7 is about 10.8 mm.

The first-time result is "initial," and the result obtained, after that, by re-building the working part and carrying out again the same stationary bending experiment is "after detachment." Furthermore, a result of FEM analysis of stationary bending in which those other than the material to be processed 1 are treated as a rigid body is "FEM analysis."

Since there is an allowable mounting error, the relationship between the stationary bending total operation amount h and the stationary bending radius of curvature R' is changed by re-building the working part. Furthermore, the result of FEM analysis qualitatively shows the same tendency as the result of a stationary bending experiment, but displacement is generated. It is considered that the displacement is caused by the way in which the fulcrum roll 5 is treated as a rigid body. In order to derive a processing coordinate on the basis of the result of FEM analysis, adjustment has to be performed so that the result of FEM analysis coincides with a result of actual processing, which is not practical.

In the present invention, there is created data to be referred to when a design shape is processed from a geometric relationship assuming an unloaded condition and a state where the material to be processed 1 and the pushing roll 7 are in contact, in addition to the relationship between the stationary bending total operation amount h and a stationary bending radius of curvature R', obtained in a stationary bending experiment. In the stationary state shown in FIG. 5(*b*), a bending moment caused by the pushing roll 7 acts on the material to be processed 1, and thus springback is not completed in the material to be processed 1 positioned between Pt5 and Pt7. As the material to be processed 1 is fed out, the material to be processed 1 positioned between Pt5 and Pt7 passes Pt7, and the springback is completed to thereby give a curvature of 1/R'.

A state where a bending moment caused by the pushing roll 7 does not act on the material to be processed 1 is defined as an unloaded condition. There is assumed a case where a state is transitioned from a stationary state to an unloaded condition shown in FIG. 5(*b*) by stopping feeding of the material to be processed 1. The bending moment that acts between Pt5 and Pt7 is eliminated, and thus springback of the material to be processed 1 between Pt5 and Pt7 is completed, and the wire rod between Pt5 and Pt7 becomes a uniform arc with a radius of curvature R', as shown in FIG. 5(*c*).

From the geometric relationship when the pushing roll 7 makes contact with the material to be processed 1 under the unloaded condition, reference data are created in the preliminary processing part. First, the geometric relationship will be described.

The distance between Pt5 and Pt7 under the unloaded condition is defined as an unloaded moment arm. As shown in FIG. 5(*c*), an unloaded moment arm in stationary bending is defined as an unloaded moment arm l' through the use of a small letter of l. The unloaded moment arm l' includes four types of an X-direction unloaded moment arm lx', a Z-direction unloaded moment arm lz', a diagonal unloaded moment arm lt' and an actual length along wire rod unloaded moment arm ls'.

An unloaded moment arm is selected in accordance with a reference standard when a design shape is processed, and in the first embodiment, a geometric relationship will be described in a case where an X-direction unloaded moment arm length is used as a standard.

The center Pt0 of the uniform arc with a radius of curvature R' in FIG. 5(*c*) is positioned in the Z-axis direction when seen from the center of the fulcrum roll 5. Furthermore, a line segment connecting Pt0 and the center of the pushing roll 7 has a length of R'+0.5 t+$r_7$. Moreover, the distance between the fulcrum roll 5 and the pushing roll 7 in the X-direction is G, and is constant. From the above, when an angle formed between a line segment connecting Pt0 and the center of the pushing roll 7, and the Z-axis is denoted by θ, a formula (1) is satisfied.

[Mathematic 1]

$$\sin\theta = \frac{G}{R' + 0.5t + r_7} \tag{1}$$

In addition, since the X-direction unloaded moment arm lx' in stationary bending is R'×sin θ, the relationship of a formula (2) is satisfied.

[Mathematic 2]

$$l'_x = \frac{R'G}{R' + 0.5t + r_7} \tag{2}$$

Figure 9:
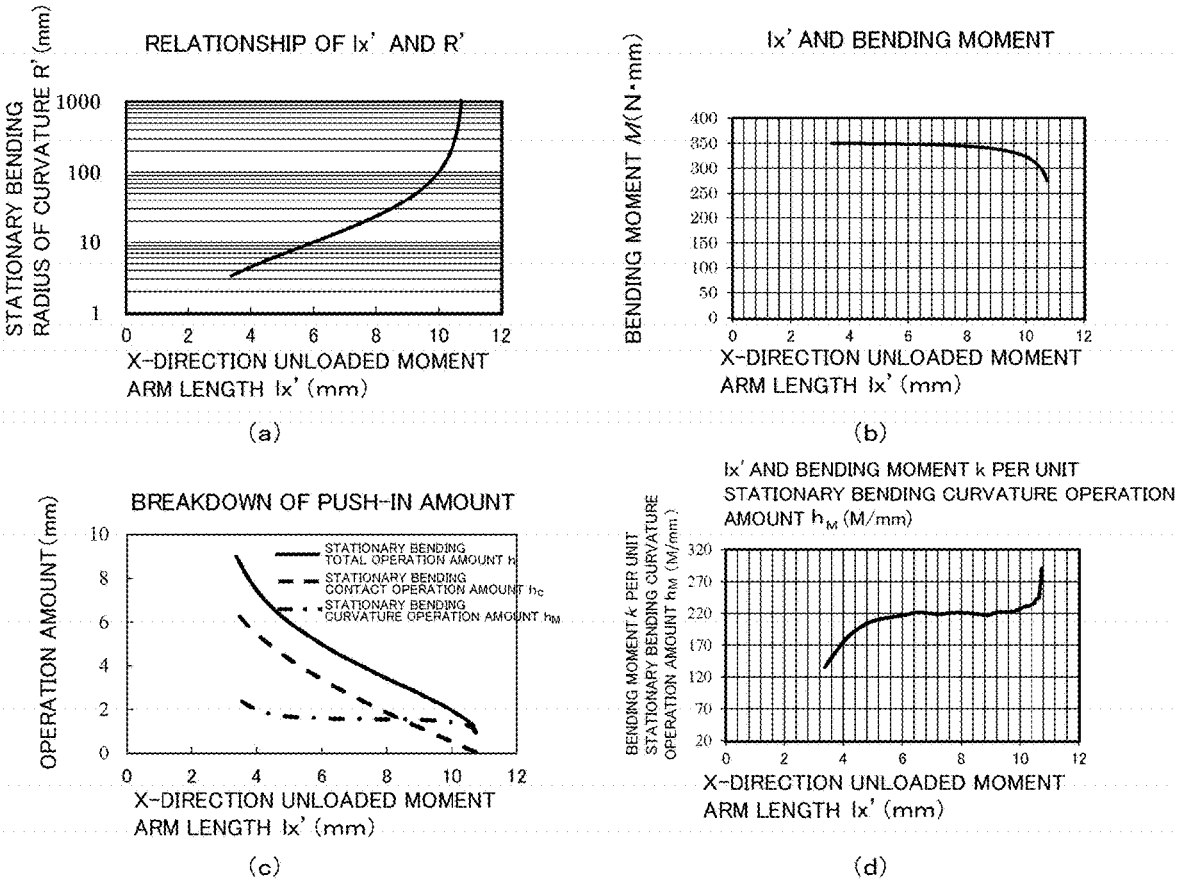
FIG. 9 is data obtained by converting stationary bending experiment data with respect to an X-direction unloaded moment arm according to the present invention.

In a case where G is about 10.8 mm, a thickness t of the material to be processed 1 is about 1.0 mm and a radius $r_7$ of the pushing roll 7 is about 8.0 mm, FIG. 9(*a*) is obtained when the formula (2) is graphed with the X-direction unloaded moment arm lx' (mm) as the horizontal axis and the radius of curvature (mm) of a uniform arc R' as the vertical axis. In FIG. 9(*a*), when lx'=G, the uniform arc R' becomes infinite. This is when the uniform arc R' shown in FIG. 4 is infinite (linear line).

Reference data are created in the preliminary processing part. A preparation procedure of reference data is divided into three: (A) calculation of a moment at Pt5 at the time of processing from the stationary bending radius of curvature R', (B) calculation of a stationary bending curvature operation amount $h_M$ associated with imparting curvature in the stationary bending total operation amount h, and (C) calculation of bending moment per unit stationary bending curvature operation amount $h_M$.

(A) There will be described calculation of a bending moment at the time of processing (at the time of passing of Pt5) from a stationary bending radius of curvature R'.

An appropriate formula of a bending moment M and radius of curvature R is selected in accordance with the quality of the material to be processed 1. The radius of curvature R during the generation of the bending moment M are function of M. For example, a relational formula between the bending moment M and the radius of curvature R during the generation of the bending moment when the material to be processed 1 is an elastic perfect plastic body having a rectangular cross section is a formula (3).

[Mathematic 3]

$$M = \frac{3}{2}M_E\left[1 - \frac{1}{3}\left(\frac{R}{\rho_E}\right)\right]^2 \left(\text{However, } M_E = \frac{EI}{\rho_E} = \frac{1}{6}bt^2Y,\ \rho_E = \frac{E}{2Y}t\right) \quad (3)$$

(a longitudinal elasticity coefficient is denoted by E, a second moment of area is denoted by I, a proof stress is denoted by Y, an elastic limit moment is denoted by $M_E$, and an elastic limit radius of curvature is denoted by $\rho_E$)

A value of a radius of curvature R' after the completion of springback is derived by substitution of the formula (3) into a general springback formula (4).

[Mathematic 4]

$$\frac{1}{R'} = \frac{1}{R} - \frac{M}{EI} \quad (4)$$

From formulae (3) and (4), there is produced a function that calculates back the bending moment M received by a wire rod, while using the radius of curvature R' after completion of springback as a variable, and the bending moment M is obtained. In the case of formulae (3) and (4), a tertiary equation relative to R is given and three solutions mathematically exist, but an appropriate solution is limited to one from conditions of plastic processing.

In accordance with the quality of material, it is preferable that a relational formula of a moment and a curvature such as a two straight-line hardening rule or an n-th power hardening rule is suitably selected. Even in a case where any relational formula is used, from any one piece of information of the bending moment M, the radius of curvature R during processing, and the radius of curvature R' after springback, remaining information can be calculated back.

Regarding the graph in FIG. 9(*a*) of an X-direction unloaded moment arm lx' (mm) in the horizontal axis and a radius of curvature (mm) of a uniform arc R' in the vertical axis, the graph in FIG. 9(*b*) is obtained by back calculation of a bending moment at the time of processing (at the time of passing of Pt5) from the radius of curvature (mm) of the uniform arc R' in the vertical axis.

Next, there will be described (B) calculation of a stationary bending curvature operation amount $h_M$ associated with imparting curvature in the stationary bending total operation amount h. As shown in FIG. 5(*c*), the operation amount of the roll 7 under an unloaded condition when the roll 7 makes contact with the material to be processed 1 is defined as a stationary bending geometric operation amount $h_C$. Furthermore, the difference between the stationary bending total operation amount h shown in FIG. 5(*b*) and the stationary bending geometric operation amount $h_C$ is defined as a stationary bending curvature operation amount $h_M$. A calculation formula of the stationary bending geometric operation amount $h_C$ is a formula (5). θ can be obtained from the formula (1), and thus the value of stationary bending geometric operation amount $h_C$ in accordance with R' can be obtained.

[Mathematic 5]

$$h_C = (R' + 0.5t + r_7)(1 - \cos\theta) \quad (5)$$

As to the graph in FIG. 9(*a*) of the X-direction unloaded moment arm lx'(mm) in the horizontal axis and the radius of curvature (mm) of a uniform arc R' in the vertical axis, a graph shown by a solid line in FIG. 9(*c*) is obtained when the radius of curvature (mm) of a uniform arc R' in the vertical axis is converted to the stationary bending total operation amount h by the use of the approximation formula of the stationary bending total operation amount h and the curvature of a uniform arc (1/R') obtained in FIG. 7(*b*).

Moreover, as to the graph in FIG. 9(*a*) of the X-direction unloaded moment arm lx' (mm) in the horizontal axis and the radius of curvature (mm) of a uniform arc R' in the vertical axis, a graph shown by a dotted line in FIG. 9(*c*) is obtained when the radius of curvature (mm) of a uniform arc R' in the vertical axis is converted to the stationary bending geometric operation amount $h_C$ by the use of formulae (1) and (5).

The X-direction unloaded moment arm lx' (mm) in the horizontal axis and the stationary bending curvature operation amount $h_M$ in the vertical axis shown by a dashed one-dotted line in FIG. 9(*c*) are obtained by calculating the difference of the stationary bending geometric operation amount $h_C$ from the stationary bending total operation amount h. The bending moment M obtained in (A), shown in FIG. 9(*b*) is generated by the stationary bending curvature operation amount $h_M$.

Figure 10:
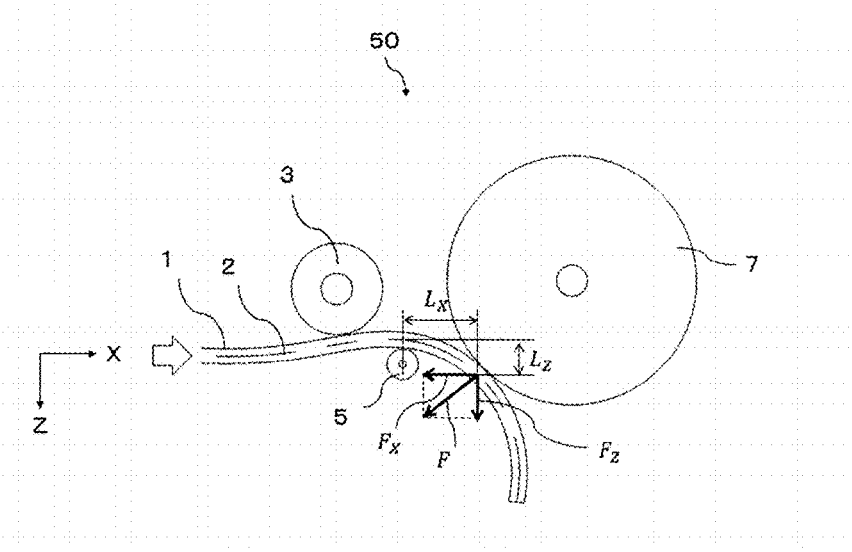
FIG. 10 is a schematic view about general calculation of a bending moment.

Next, there will be described (C) calculation of a bending moment per unit stationary bending curvature operation amount $h_M$. Generally, a bending moment can be obtained as force×a moment arm length in action. When a concrete description is made by taking a case of FIG. 10 as an example, the bending moment is obtained as $F_X \times L_Z + F_Z \times L_X$ by the use of an X-direction component force $F_X$ and a Z-direction component force $F_Z$ of a force F acting on the material to be processed 1, and an X-direction moment arm length $L_X$ and a Z-direction moment arm length $L_Z$ in action. In the obtaining method, it is necessary to grasp the X-direction length $l_X$ and the Z-direction length $l_Z$ and the X-direction component force $F_X$ and the Z-direction component force $F_Z$ of acting force F between Pt5 and Pt7 during processing, but it is very difficult to grasp these for every point in a case of processing a shape having a continuously changing curvature.

Accordingly, a bending moment is treated as a product of an unloaded moment arm and a curvature operation amount. When an X-direction unloaded moment arm length is used as a standard, bending moment=X-direction unloaded moment arm lx'×stationary bending curvature operation amount $h_M$ holds.

A bending moment per unit stationary bending curvature operation amount $h_M$ can be derived from the graph of bending moment in FIG. 9(*b*) and the stationary bending curvature operation amount $h_M$ shown by a dashed one-dotted line in FIG. 9(*c*). For example, when linear approximation is carried out, there is obtained a graph shown in FIG. 9(*d*), in which the horizontal axis is the X-direction unloaded moment arm lx' (mm) and the vertical axis is bending moment k per unit stationary bending curvature operation amount $h_M$ by division of the bending moment in FIG. 9(*b*) by the stationary bending curvature operation amount $h_M$ shown by the dashed one-dotted line in FIG. 9(*c*). The bending moment k per unit curvature operation amount $h_M$ which uses, as a standard, an unloaded moment arm having been obtained by the above becomes reference data to be created in the preliminary processing part.

The case where the X-direction unloaded moment arm is used as a reference standard has been described, but when the actual length unloaded moment arm ls' is used as a reference standard, data may be created through the above-described procedure by the use of ls'=R'θ. When the diagonal unloaded moment arm lt' is used as a reference standard, a relational formula of lt' and R' may be used from lx' and lz'. When a design shape is to be processed, reference data are referred to by the use of the unloaded moment arm set to the reference standard as a standard.

Next, with reference to FIG. 11, there will be described the design processing part that calculates "design data" in a case where an X-direction unloaded moment arm length is used as a reference standard. The design shape that is a shape after processing is a shape under an unloaded condition in which a bending moment does not act. In the same way as the preliminary processing part, a geometric relationship of a design shape under an unloaded condition is to be grasped.

Figure 11:
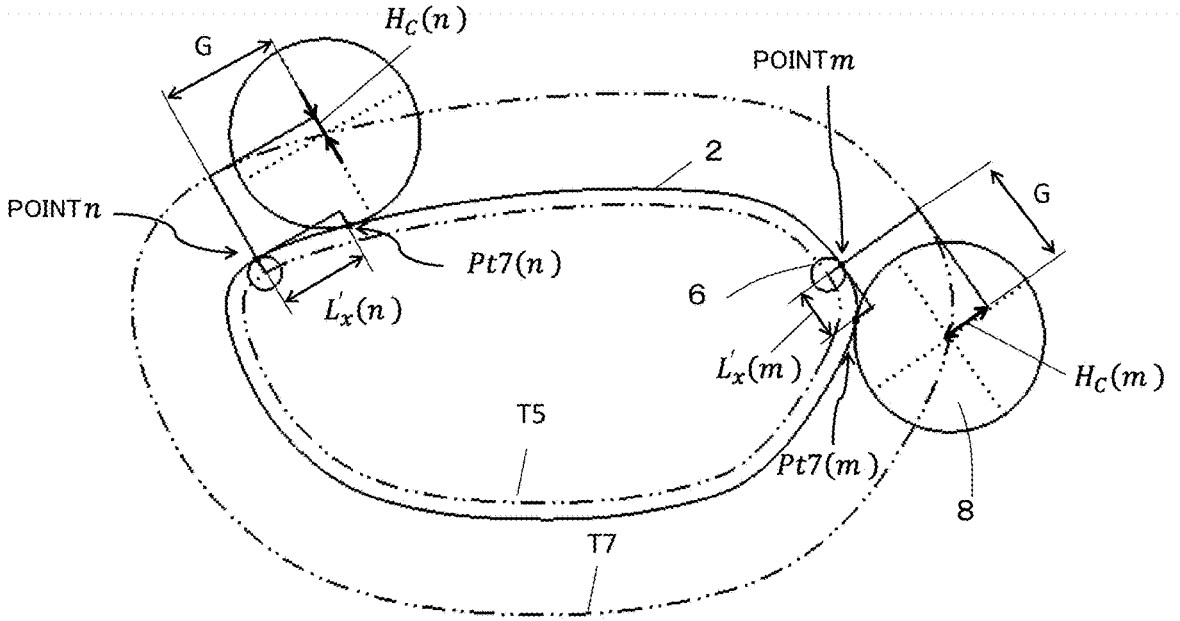
FIG. 11 is a schematic view of a method for acquiring design data according to the present invention.

As shown in FIG. 11, description will be made by taking, neutral line 2 of a design shape is created by N+1 points from P(0) to P(N) with prescribed division pitches, and each design radius of curvature ρ' (long n) of the respective points is grasped. For each of these points, an instant at which a point becomes Pt5 exists along with the advance of processing. The division pitch is desirably as fine as possible in order to perform processing with high accuracy, and is appropriately and approximately 0.1 mm to 1 mm.

A locus T5 of the center of the fulcrum roll 5 is plotted by offsetting the neutral line 2 by $r_5$+0.5 t, in which there are added $r_5$ that is the radius of the fulcrum roll 5 and 0.5 t that is a half of the thickness of a material to be processed. Also in the similar way as a locus of the center of the pushing roll 7, a locus T7 of the center of the pushing roll 7 is plotted by offsetting the neutral line by $r_7$+0.5 t, in which there are added $r_7$ that is the radius of the pushing roll 7 and 0.5 t that is a half of the thickness of a material to be processed. In a case where the material to be processed 1 has an irregular cross-sectional shape, the offset amount is suitably corrected in accordance with the shape.

As long as the fulcrum roll 5 moves along the locus T5 and the center of the pushing roll 7 moves along the locus T7, an unloaded condition and a state of making contact with a design shape are reached. There are obtained an operation amount required for the contact of the material to be processed 1 with the roll 7 and contact point Pt7 when each of points on the neutral line 2 passes Pt5 under an unloaded condition by considering a constraint condition that the X-direction distance between centers of the fulcrum roll 5 and the pushing roll 7 is G in addition to the above.

In order to distinguish from stationary bending, by the use of a capital letter H, an operation amount required for the contact of the material to be processed 1 with the roll 7 is denoted by a design geometric operation amount $H_C$, a design geometric operation amount at point n is denoted by $H_C$(n), and Pt7 is denoted by Pt7(*n*).

In addition, an unloaded moment arm in a design shape can be grasped from Pt7(*n*) of respective points under an unloaded condition, an unloaded moment arm in a design shape can be grasped. In order to distinguish from a case of stationary bending, an unloaded moment arm L' is defined by the use of a capital letter L. The unloaded moment arm L' includes four types, that is, an X-direction unloaded moment arm Lx', a Z-direction unloaded moment arm Lz', a diagonal unloaded moment arm Lt' and an actual length unloaded moment arm Ls' along a design shape, and the unloaded moment arm L' is obtained from an unloaded moment arm to be used for a reference standard. In a similar way to in the operation amount, an unloaded moment arm at a point n is denoted by L'(n) {(Lx'(n), Lz'(n), Lt'(n), Ls'(n)}.

From the above, there are obtained, at a point non a design shape, a design radius of curvature ρ'(n), a design geometric operation amount Hc (n) and an unloaded moment arm length L'(n) to be a reference standard, for all points on the neutral line of the design shape.

Figure 12:
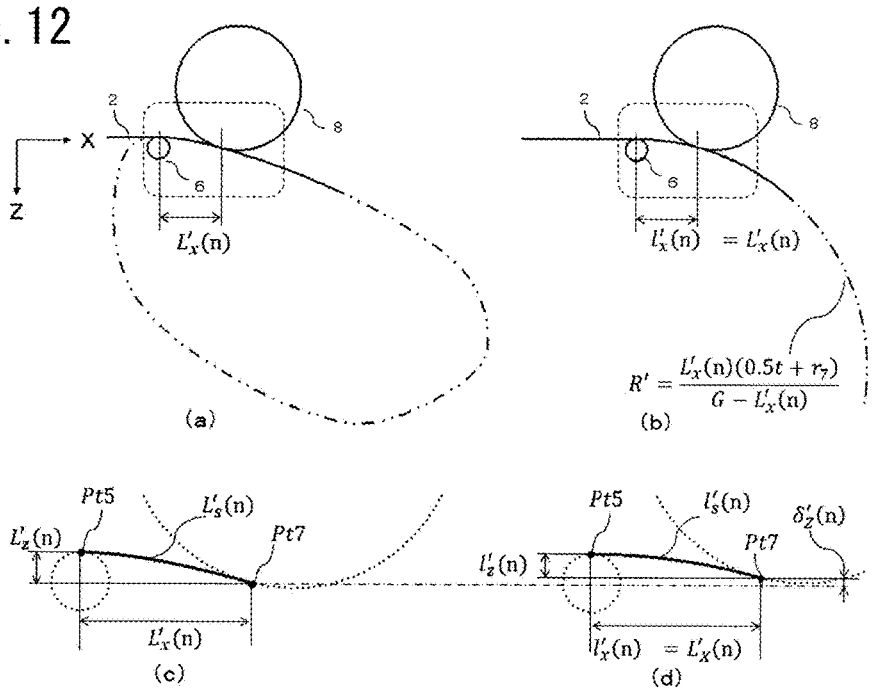
FIG. 12 is a schematic view assuming an unloaded condition at the time of processing of a design shape according to the present invention.
Figure 13:
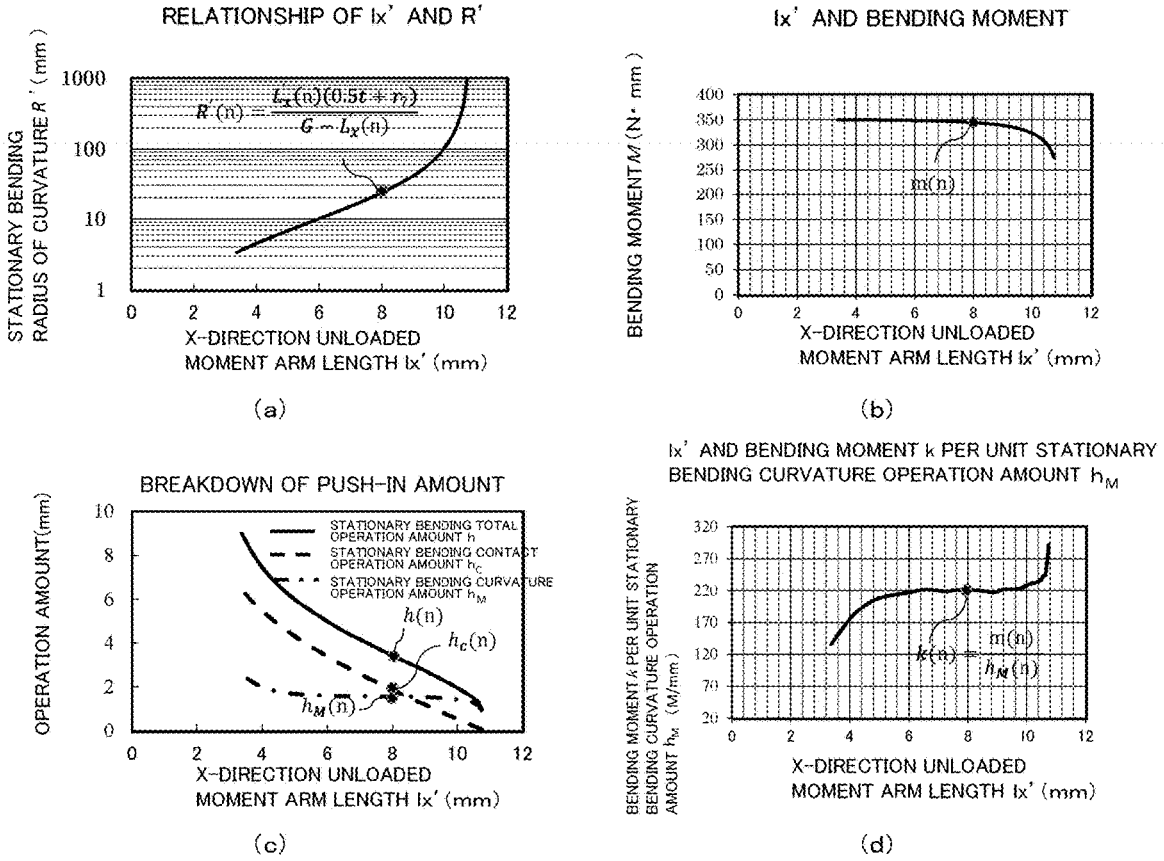
FIG. 13 is a schematic view showing reference points of respective graphs when reference data are referred to according to the present invention.
Figure 16:
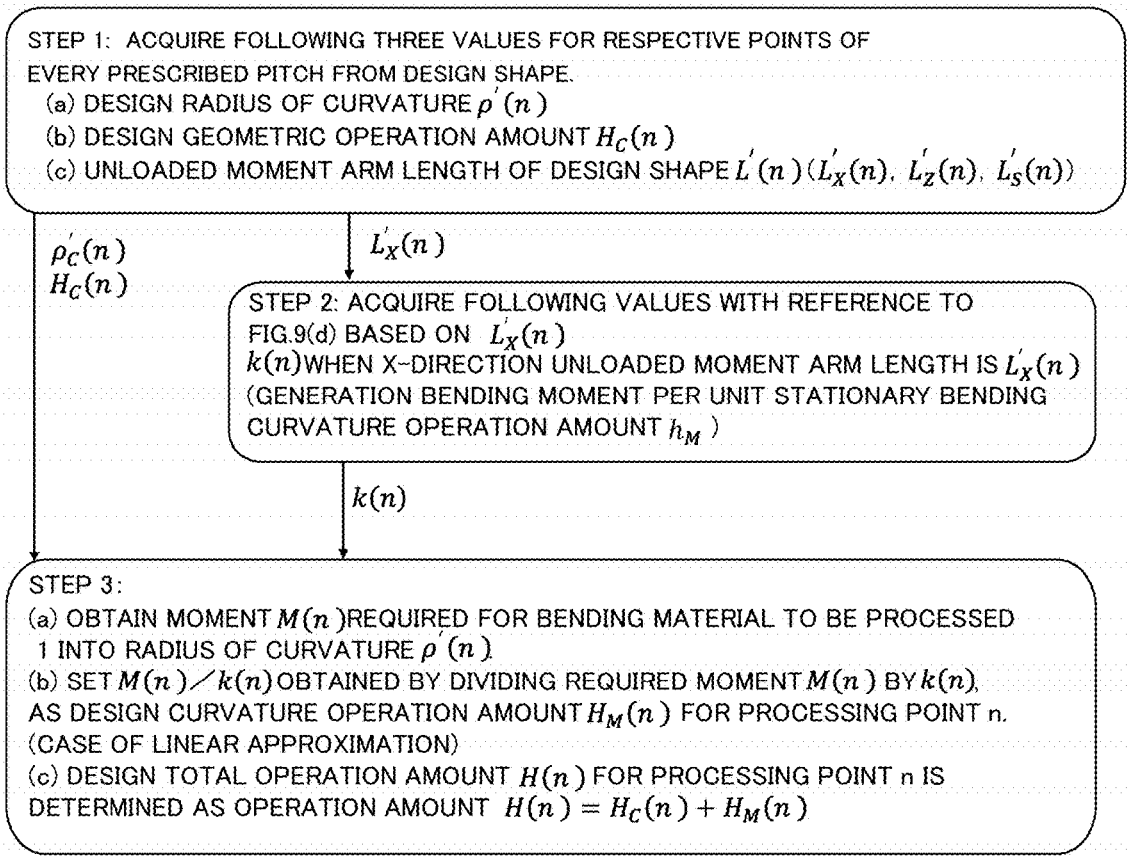
FIG. 16 is a processing flow for obtaining a design total operation amount H(n).

Next, with reference to FIGS. 12 and 13, there will be described the calculation processing part that calculates an "operation amount" for processing a design shape in a case where the X-direction unloaded moment arm length is used as a reference standard. In FIG. 12(*a*), there is shown a schematic view when the point n in FIG. 11 becomes Pt5. In the design processing part, the design geometric operation amount $H_C$ (n) has been acquired, and thus a design total operation amount H(n) is obtained by determining a design curvature operation amount $H_M$(n) that is an operation amount for imparting a curvature to the point n and by adding the design curvature operation amount $H_M$(n) to the design geometric operation amount $H_C$(n). FIG. 16 shows a processing flow for calculating the design total operation amount H(n).

With reference to reference data shown in FIG. 9(*d*), there are received data of a bending moment per unit stationary bending curvature operation amount in the X-direction unloaded moment arm Lx'(n), which is denoted by k(n).

A specification is also allowable in which calculation is carried out for every point of a design shape by using, as a return value, a bending moment k per unit stationary bending curvature operation amount without previous creation of reference data.

Next, there is to be obtained the design curvature operation amount $H_M$(n) required for carrying out bending so as to give the design radius of curvature ρ'(n) at a point n. A required moment required for carrying out bending so as to give the design radius of curvature ρ'(n) at a point n is obtained from the same formula as that used for calculating a bending moment in creation of reference data in the preliminary processing part, which is denoted by a design curvature required moment M(n). The design curvature operation amount $H_M$(n) is obtained by division of the design curvature required moment M(n) by the bending moment k(n) per unit stationary bending curvature operation amount.

The design total operation amount H (n) is determined by addition of the design curvature operation amount $H_M$(n) and the design geometric operation amount $H_C$(n), obtained as described above. There is obtained data of operation amount of the pushing roll 7 in accordance with feeding amounts of the material to be processed 1 by carrying out this for all points of the neutral line 2 of a design shape.

According to the data, the controlling part 40 controls the operation amount of the pushing roll 7 of the working part 50, the supply amount of the material to be processed 1 in the supply part 60, and the feeding amount of the material to be processed 1 in the feeding part 70. Accordingly, processing with high accuracy can be carried out even if a curvature continuously changes in a design shape.

Practical advantages of the present invention include following matters. The roll-bending processing method of the present invention can be carried out at low cost by a commercially available spreadsheet software. Furthermore, since no repeated calculation is included, processing coordinates can be calculated in a short period of time. Moreover, the stationary bending experiment may be a simple work of measuring the diameter of a processed uniform arc by using a slide caliper or the like, and thus is practical.

In addition, the experiment exerts an effect of suppressing an error, as described below. A bending moment obtained from back calculation of the stationary bending radius of curvature R'(n) is denoted by a stationary bending required moment m(n). As shown in FIG. 13, a datum k(n) returned by referring to reference data is stationary bending required moment m(n)/stationary bending curvature operation amount $h_M(n)$, and thus a formula for deriving the design curvature operation amount $H_M(n)$ is obtained by division of the design curvature required moment M(n) by the stationary bending required moment m(n), as shown by a formula (6).

[Mathematic 6]

$$H_M(n) = M(n) \Big/ \frac{m(n)}{h_M(n)} = h_M(n)\frac{M(n)}{m(n)} = h_M(n)\frac{\frac{3}{2}M_E\left[1-\frac{1}{3}\left\{\frac{\rho(n)}{\rho_E}\right\}^2\right]}{\frac{3}{2}M_E\left[1-\frac{1}{3}\left\{\frac{R(n)}{\rho_E}\right\}^2\right]} \quad (6)$$

As known from the formula (6), the elastic limit moment $M_E$ disappears and the second moment of area I depending on the cross-sectional shape of the material to be processed 1 also disappears. Accordingly, even in a case where the cross-sectional shape changes when the material to be processed 1 passes a correction machine, a feeding part or the like, the influence thereof can be suppressed.

In addition, when the selection of the relational formula of a bending moment and a radius of curvature of the formula (3) is not appropriate, an error directly appears in a technique based on an FEM analysis or theoretical analysis, but, in the method according to the present invention, since the design curvature required moment M(n) is divided by the stationary bending required moment m(n), there is also an effect of suppressing an error.

Furthermore, although information about a positional relation of three rolls of the pressing roll 3, the fulcrum roll 5 and the pushing roll 7 is required in an FEM analysis, there is an advantage that information about a positional relation of two rolls of the fulcrum roll 5 and the pushing roll 7 is sufficient according to the method of the present invention.

(Second Embodiment)

A roll-bending processing method of a second embodiment according to the present invention will be described. The second embodiment includes the same configuration as that of the first embodiment, except for using two kinds of stationary bending experiment data according to the presence/absence of the contact of the material to be processed 1 with the interference prevention guide 10.

According to a design shape, it becomes necessary to prevent the interference of the material to be processed 1 with the material to be processed 1 itself or various rolls by the use of the interference prevention guide 10. In this case, consequently, processing is carried out while the material to be processed 1 makes contact with the interference prevention guide 10. Friction resistance is generated by this contact, and even when an operation amount is the same, a radius of curvature into which the material to be processed 1 is formed changes.

There is performed a stationary bending experiment in which the material to be processed 1 makes contact with the interference prevention guide 10, the result is added to reference data in the preliminary processing part, the reference data is properly used depending on the presence/absence of the contact of the material to be processed 1 with the interference prevention guide 10 when the material to be processed 1 is processed into a design shape, and thus the processing accuracy of the material to be processed 1 can be enhanced.

(Third Embodiment)

A roll-bending processing method of a third embodiment according to the present invention will be described with reference to FIGS. 11 to 13. The third embodiment includes the same configuration as that of the first embodiment, except for using, as a correction variable, at least one or more unloaded moment arms other than the unloaded moment arm used as a reference standard.

Description will be made using a case in which a reference standard is set as the X-direction unloaded moment arm Lx' and the Z-direction unloaded moment arm Lz' is used for correction.

In a case where an unloaded condition is given when the point n in FIG. 11 comes near to the fulcrum roll 5, the X-direction distance between Pt5 and Pt7 becomes Lx'(n) as shown in FIG. 12(*c*). Since Lx'(n) is used as a reference standard, a data is referred to at which the X-direction unloaded moment arm lx'(n) in the stationary bending becomes Lx'(n), but a deviation δz'(n) is generated between the Z-direction unloaded moment arm Lz'(n) of a design shape and the Z-direction unloaded moment arm lz'(n) of stationary bending. Accuracy of a processed shape can be enhanced by utilization of the deviation δz'(n) as a correction coefficient for the design shape total operation amount H(n).

Next, processing was performed by two methods of the method according to the present invention and a comparative method. There were used a material to be processed and a roll-bending processing device similar to those used in the stationary bending experiment shown in FIG. 7. Then, roll-bending processing was performed on the basis of a processing according to the first embodiment. In a comparative example, in the similar way to in the preliminary processing part of the first embodiment, a stationary bending experiment was carried out and relationship between the stationary bending total operation amount h and the stationary bending radius of curvature R' was previously obtained; and a stationary bending total operation amount h at which a radius of curvature of stationary bending became ρ'(n) when a design radius of curvature of a point n of a design shape was ρ'(n), was set to a design shape total operation amount H(n).

Figure 14:
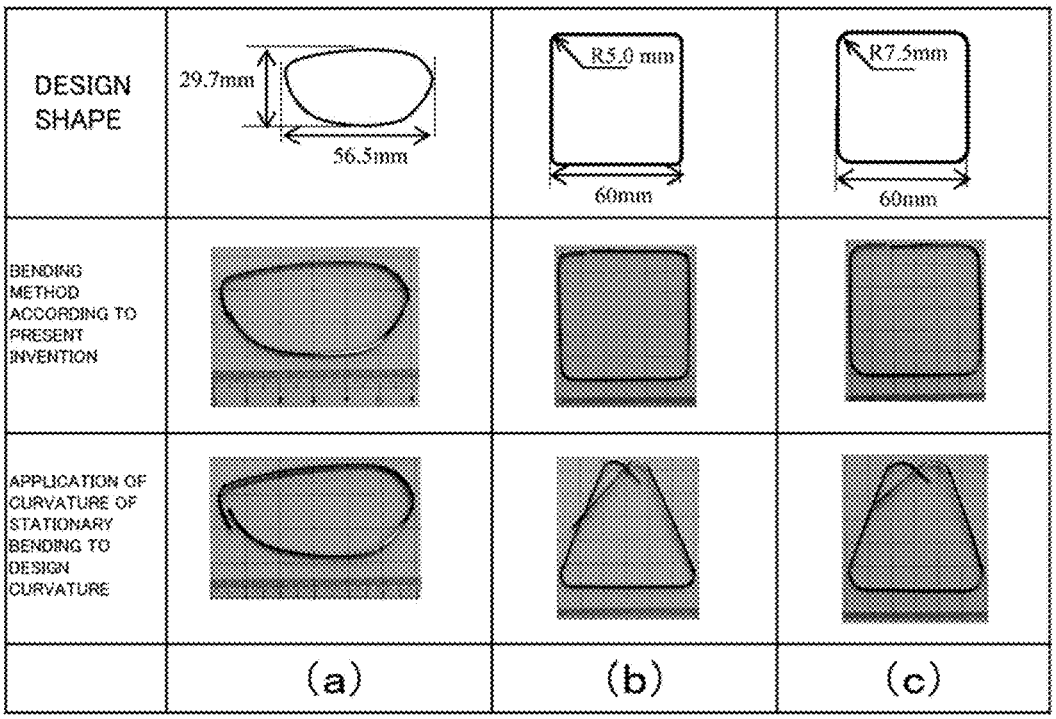
FIG. 14 is a photograph of a titanium alloy processed by a method of the present invention.

FIG. 14 illustrates photographs showing processing examples of the two. FIG. 14(*a*) illustrates a rim shape of eyeglasses and the maximum curvature is about 235 ($m^{-1}$). FIG. 14(*b*) illustrates a shape obtained by filleting a corner of a square having a side of 60 mm so as to give R of 5 mm, and FIG. 14(*c*) illustrates a shape obtained by filleting a corner of a square having a side of 60 mm so as to give R of 7.5 mm.

When processing is carried out as in the comparative example, the processed shape in FIG. 14(*a*) in which the curvature continuously changes is comparatively close to the design shape, but displacement becomes large as to FIGS. 14(*b*) and 14(*c*) in which there is a point at which the curvature rapidly changes. In contrast, in the above-described first embodiment, processed shapes close to design shapes were able to be obtained for all shapes.

Figure 15:
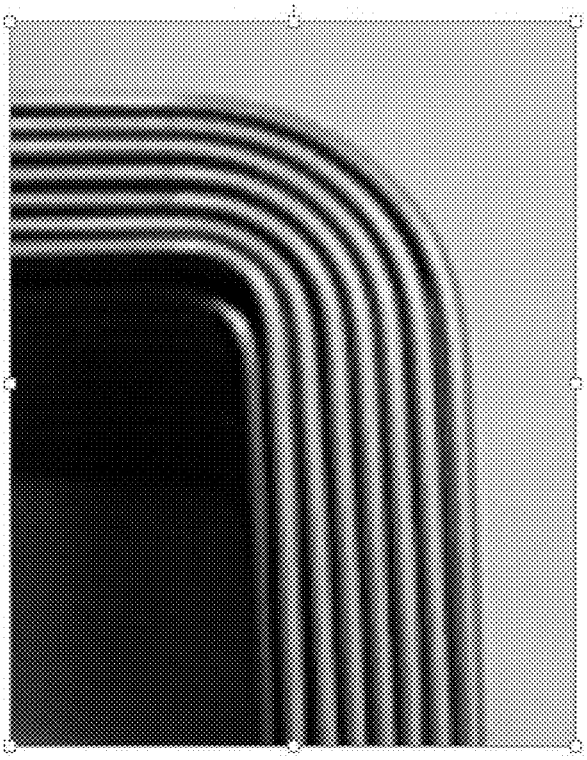
FIG. 15 is a photograph of an insulation-coated copper wire processed by a method of the present invention.

FIG. 15 illustrates a photograph of a roll-bending processing example obtained by subjecting commercially available copper wire having a rectangular cross section (width: 2 mm, thickness: 1 mm) to the processing according to the first embodiment. Processing was carried out at a radius of curvature of a corner on the outermost side of about 11 mm, and at radii of curvature sequentially offset about 1 mm on the inside thereof. According to the method of the present invention, highly accurate processing without a gap between wire rods becomes possible.

REFERENCE SIGNS LIST

1 material to be processed
2 neutral line
3 pressing roll
5 fulcrum roll
6 fulcrum roll offset circle
7 pushing roll
8 pushing roll offset circle
9 facing roll
10 interference prevention guide
11 motion of pushing roll (case of moving in linear line)
13 motion of pushing roll (case of moving in arc shape)
20 data base (for stationary bending data)
30 data base (for design shape)
40 controlling part
50 working part
60 supply part
70 feeding part
100 roll-bending processing device
401 preliminary processing part
402 design processing part
403 calculation processing part
Pt5 contact point of fulcrum roll offset circle with neutral line
Pt7 contact point of pushing roll offset circle with neutral line
T5 central trajectory of fulcrum roll 5
T7 central trajectory of pushing roll 7

The invention claimed is:

1. A roll-bending processing method for bending a material to be processed comprising:

arranging a fulcrum roll on one side of a feeding path of the material to be processed and arranging a pressing roll and a pushing roll on the other side thereof;

bending the material to be processed by controlling an amount of operation parameters, consisting of at least one of moving distance and rotation angle, of the pushing roll while continuously feeding the material to be processed, and determining the amount of operation parameters by a method comprising:

calculating reference data under an unloaded condition on the basis of bending characteristic data of the material to be processed, said bending characteristic data being obtained by carrying out a prescribed stationary bending experiment;

calculating design data under the unloaded condition on the basis of a prescribed design shape; and calculating the amount of operation parameters of the pushing roll on the basis of the reference data and the design data to thereby carry out bending processing, wherein the reference data comprises an amount of bending moment per unit stationary bending curvature operation corresponding to an unloaded moment arm;

wherein the reference data further comprises a design radius of curvature, an unloaded moment arm and a design geometric operation amount for every point of a design shape; and wherein the calculating of the amount of operation parameters of the pushing roll comprises:

(1) acquiring the amount of bending moment per unit stationary bending curvature operation of the reference data on the basis of the unloaded moment arm of the design data for every point of the design shape, (2) obtaining an amount of design curvature operation by dividing a design required moment for bending the material to be processed into a design radius of curvature by the acquired bending moment per unit stationary bending curvature operation amount, and (3) adding together the obtained amount of design curvature operation and the amount of design geometric operation to thereby obtain the amount of operation parameters of the pushing roll.

2. The roll-bending processing method according to claim 1, the method further comprising:

calculating, as the reference data, the amount of unit stationary bending curvature operation in accordance with the unloaded moment arm in a case where the material to be processed makes contact or does not make contact with an interference prevention guide, and selecting the amount of unit stationary bending curvature operation parameters in accordance with the unloaded moment arm in either of cases where the material to be processed makes contact or does not make contact with an interference prevention guide to thereby calculate the amount of operation parameters of the pushing roll.

3. The roll-bending processing method according to claim 1, the method further comprising:

calculating, as the reference data, an unloaded moment arm for correction independently of the unloaded moment arm, and correcting the operation amount force of the pushing roll on the basis of the unloaded moment arm for correction.

4. The roll-bending processing method according to claim 2, the method further comprising:

calculating, as the reference data, an unloaded moment arm for correction independently of the unloaded moment arm, and correcting the amount of operation parameters of the pushing roll on the basis of the unloaded moment arm for correction.

5. A roll-bending processing device comprising:

a feeding part that continuously feeds a material to be processed along a prescribed feeding path;

a working part that carries out bending processing by pushing a pushing roll against the material to be processed, with a fulcrum roll arranged on one side of the feeding path, and with a pressing roll and the pushing roll arranged on the other side; and a controlling part that controls an amount of operation parameters of the pushing roll to thereby bend the material to be processed while continuously feeding the material to be processed toward the pushing roll by controlling the feeding part, wherein the controlling part includes:

a preliminary processing part that calculates reference data under an unloaded condition on the basis of bending characteristic data of a material to be processed obtained by carrying out a prescribed stationary bending experiment;

a design processing part that calculates design data under an unloaded condition on the basis of a design shape; and a calculation processing part that:

(a) calculates an amount of operation parameters of the pushing roll on the basis of the reference data and the design data, (b) calculates, as the reference data, an amount of bending moment per unit stationary bending curvature operation corresponding to an unloaded moment arm; and (c) calculates, as the reference data, a design radius of curvature, an unloaded moment arm and a design geometric operation amount for every point of a design shape;

wherein the calculation processing part further:

acquires the amount of bending moment per unit stationary bending curvature operation of the reference data on the basis of the unloaded moment arm of the design data for every point of the design shape, obtains an amount of design curvature operation by dividing a design required moment for bending the material to be processed into a design radius of curvature by the amount of acquired bending moment per unit stationary bending curvature operation, and adds together the obtained amount of design curvature operation and the amount of design geometric operation to thereby calculate the amount of operation parameters of the pushing roll.

* * * * *